US006339058B1

(12) United States Patent
Toussaint et al.

(10) Patent No.: US 6,339,058 B1
(45) Date of Patent: Jan. 15, 2002

(54) LIGHT DUTY LIQUID COMPOSITION CONTAINING GELATIN BEADS AND POLYACRYLATE THICKENER

(75) Inventors: Christine Toussaint, Aineffe; Louis Oldenhove, Heks; Guy Broze, Grace-Hollogne, all of (BE)

(73) Assignee: Colgate-Palmolive Co., Piscataway, NJ (US)

( * ) Notice: Subject to any disclaimer, the term of this patent is extended or adjusted under 35 U.S.C. 154(b) by 0 days.

(21) Appl. No.: 09/899,484

(22) Filed: Jul. 5, 2001

(51) Int. Cl.[7] ..... C11D 17/00

(52) U.S. Cl. ..... 510/425; 510/424; 510/426; 510/476; 510/477; 510/499

(58) Field of Search ..... 510/425, 424, 510/426, 476, 477, 499

(56) References Cited

U.S. PATENT DOCUMENTS 5,073,292 A * 12/1991 Hessel et al. ..... 252/174.12
5,385,696 A * 1/1995 Repinec et al. ..... 252/550
5,387,375 A * 2/1995 Erilli et al. ..... 252/546
5,389,304 A * 2/1995 Repinec et al. ..... 252/546
5,389,305 A * 2/1995 Repinec et al. ..... 252/549
5,866,529 A * 2/1999 Erilli et al. ..... 510/425

* cited by examiner

*Primary Examiner*—Necholus Ogden
(74) *Attorney, Agent, or Firm*—Richard E. Nanfeldt

(57) ABSTRACT

A high foaming, light duty, liquid detergent with desirable cleansing properties and mildness to the human skin comprising a water soluble nonionic surfactant, a sulfate anionic surfactant, a sulfonate anionic surfactant, a polyethylene glycol, stably suspended oil containing gelatin beads, a polyacrylate polymeric thickener and water.

6 Claims, No Drawings

LIGHT DUTY LIQUID COMPOSITION CONTAINING GELATIN BEADS AND POLYACRYLATE THICKENER

FIELD OF THE INVENTION

The present invention relates to novel light duty liquid cleaning compositions with high foaming properties and having the appearance of suspended beads therein which contains a sulfonate surfactant, an ethoxylated alkyl ether sulfate surfactant, a nonionic surfactant, gelatin beads containing an oil, a crosslinked polyacrylate type polymer, an inorganic magnesium salt, a polyethylene glycol and the balance being water.

BACKGROUND OF THE INVENTION

Nonionic surfactants are in general chemically inert and stable toward pH change and are therefore well suited for mixing and formulation with other materials. The superior performance of nonionic surfactants on the removal of oily soil is well recognized. Nonionic surfactants are also known to be mild to human skin. However, as a class, nonionic surfactants are known to be low or moderate foamers. Consequently, for detergents which require copious and stable foam, the application of nonionic surfactants is limited. There have been substantial interest and efforts to develop a high foaming detergent with nonionic surfactants as the major ingredient. Yet, little has been achieved.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants alkanolamines and magnesium salts, and, optionally, zwitterionic is surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient. The specific class of anionics utilized in this patent is the very same group of anionic detergents expressly excluded in present invention in order to eliminate the alkanol ethoxylate sulfation process and the potential dioxane toxicity problem. Furthermore, this patent finds heavily foaming detergents undesirable for the purpose of washing socks.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions in contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

U.S. Pat. 5,866,529 teaches a light duty liquid cleaning composition containing gelatin beads and a Laponite clay, wherein this patent specifically excludes polyacrylic acid polymeric thickeners.

However, none of the above-cited patents discloses a high foaming, liquid detergent composition containing a nonionic surfactant, two high foaming anionic surfactants, an inorganic magnesium salt, polyethylene glycol, an oil containing gelatin bead, a crosslinked polyacrylate polymer and water wherein the composition does not contain any polymeric thickeners such as cellulosics or xanthan gum or a Laponite clay.

SUMMARY OF THE INVENTION

It has now been found that a high foaming liquid light duty liquid cleaning composition has desirable cleaning properties, mildness to the human skin and improved aesthetics. Accordingly, one object of the invention is to provide novel, high foaming, light duty liquid detergent compositions containing a nonionic surfactant, suspended oil containing gelatin beads and a polyacrylate type polymeric thickener.

Another object of this invention is to provide novel, liquid detergent compositions containing a nonionic surfactant, two anionic surfactants, an inorganic magnesium salt, polyacrylate type polymer, suspended oil containing gelatin beads and water [wherein the composition does not contain any builder salts, polymeric thickeners such as cellulosics or xanthan gum, alkyl glycine surfactant, Laponite clay, cyclic imidinium surfactant, N-polyvinyl pyrrolidone homopolymer, copolymer of N-polyvinyl pyrrolidone and dimethyl-aminoethyl methacrylate, or abrasives].

Still another object of this invention is to provide a novel, liquid detergent with a desirable high foaming and cleaning properties which is mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the novel, high foaming, light duty liquid cleaning compositions of this invention comprises a water soluble, ethoxylated, nonionic surfactant, two anionic surfactants selected from the group consisting of water soluble organic sulfates and organic sulfonates, suspended oil containing gelatin beads, wherein the composition does not contain any formate, HETDA, abrasives, builder salts, polymeric thickeners such as cellulosics or xanthan gum, a Laponite clay, fatty acids, alkyl glycine surfactant or cyclic imidinium surfactant.

DETAILED DESCRIPTION OF THE INVENTION

The present invention relates to a light duty liquid cleaning composition which comprises approximately by weight:

(a) 1% to 10%, more preferably 2% to 8% of a nonionic surfactant;

(b) 0.1% to 6%, more preferably 0.25% to 4% of a polyethylene glycol;

(c) 20% to 40%, more preferably 22% to 30% of an anionic sulfonate surfactant;

(d) 0.25% to 8%, more preferably 0.5% to 6% of an anionic sulfate surfactant;

(e) 0 to 8%, more preferably 0.25% to 5% of an inorganic magnesium salt;

(f) 22% to 5%, more preferably 2.4% to 4% of a polyacrylate type polymeric thickener;

(g) 0.01% to 2% of an alkali metal hydroxide, preferably potassium hydroxide.

(h) 0.05% to 4%, more preferably 0.1% to 2% of oil containing gelatin beads which are stably suspended within the liquid composition as discrete particles; and (i) the balance being water, wherein the composition has a pH of about 5.5 is to 1.5, preferably 6 to 7.

The water soluble nonionic surfactants utilized in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic surfactants generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic surfactant class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8–15 and give good O/W emulsification, whereas ethoxamers with HLB values below 8 contain less than 5 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic surfactants include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of dinonyl phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described shampoo. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

The anionic sulfonate surfactants are water soluble such as triethanolamine and include the sodium, potassium, ammonium and ethanolammonium salts of linear $C_8$–$C_{16}$ alkyl benzene sulfonates and $C_{10}$–$C_{20}$ paraffin sulfonates, wherein the preferred salt is potassium. The preferred paraffin sulfonate is present in the composition as the sodium salt at a concentration of about 20 to about 6 wt. %, more preferably about 0.5 to about5 wt. %.

The alkyl ether sulfate surfactants used in the instant compositions have the structure

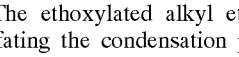

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g. sodium myristyl (3 EO) sulfate.

Ethoxylated alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

The oil containing gelatin beads which are stably suspended as discrete particles in the instant cleaning composition is composed typically of gelatin and arabeo gum. The composition microencapsulated within the gelatin bead comprises approximately by weight 30 to 50% of a mineral oil, 30 to 50% of phytocancentrol algas, 10 to 30% of silicone oil and 1 to 3% of a silver pigment. A typical gelated bead is HC774 manufactured by Hallcrest of Dorset, England.

These particles have a density generally very close to that of water, 1 gm/cm$^3$, for case of suspension and stability. A preferred density range is about 0.92 to about 1.05 gm/cm$^3$ more preferred, about 0.97 to about 1.02 gm/cm$^3$. A further desired attribute of the particle is that is has optimal visual impact to the composition user. Generally the size of the particle can vary from about 200 to about 2500 micron. Preferably the particle size is about 400 to about 2000 micron and even more preferably about 800 to about 1800 micron and most preferably about 1000 to about 1500 microns. The material comprising the particle should be compatible with water. Generally such materials can include gelatins, arabic gums, collagens, polypeptides from vegetable or animal origin, alginates, polyamides, glycosamino glycans, mucopolysaccharides, ethylcellulose and the like. Through coacervation, multicoating protein deposition, or reticulation technologies microcapsules can be formed which enclose the oil.

When applied to the surface being cleaned during normal cleansing procedures, these particles are abraded, released and deposit their contents on the surface being cleaned. Examples of "oily" materials which can be within the microcapsule are vitamins, provitamins; mineral oils, vegetable oils, emolients or animal extracts and the like. These oil bearing particles are available from Hallcrest Liquid Crystal Technology Ltd. a UK company having offices in Glenview, III, U.S.A. and from LIPO Chemicals. Other materials which can be employed are oil impregnated particles available as Elespheres from Laboratories Serobiologiques, France. Also collagen spheres and glucose amino glycans "GAG" spheres from Coletica (France) called Collaspheres or Thalaspheres. The preferred particles are the microcapsules from Hallcrest, most preferably the green, silver and iridescent colors.

The magnesium inorganic salt used in the instant composition is selected from the group consisting of magnesium chloride, magnesium oxide and magnesium sulfate and mixture thereof, wherein the preferred magnesium inorganic salt is magnesium sulfate heptahydrate.

The polyacrylate type polymeric thickener is Carbopol Aqua™ 30 manufactured by B.F. Goodrich Company. Carbopol Aqua™ 30 is a non-associate lightly crosslinked (0.03 to 3 wt. % of crosslinker) acrylate copolymer consisting of a mixture of a copolymer of methacrylic acid and a $C_1$–$C_4$ alkyl ester of the methacrylic acid and a copolymer of acrylic acid and a $C_1$–$C_4$ alkyl ester of the acrylic acid, wherein the weight ratio of the methacrylic acid copolymer to the acrylic acid copolymer is about 2:1 to 1:2 and the molecular weight of the Carbopol Aqua™ 30 is about 500,000 to 1,500,000. The use of the Carbopol Aqua™ 30 in the instant composition provides the formation of viscoelastic properties while maintaining acceptable flowability thereby permitting the stable suspension of the gelation beads as discrete particles.

G' and G" values which are obtained with Carbopol Aqua™ 30 cannot be expressed independently of the composition of the liquid base. The profiles of these rheological parameters are given in examples 1-B, 1-A and 1-C for increasing levels (i.e. 2.0, 2.5 and 3.0 % respectively) of Carbopol Aqua™ 30 incorporated in the same surfactant base. In these conditions, G' varies at 25° C. from 10 to 63 Pa and G" varies from 14 to 43 Pa (for a frequency of 1 Hertz and a strain of 1%).

In addition to the previously mentioned essential and optional constituents of the light duty liquid detergent, one may also employ normal and conventional adjuvants, provided they do not adversely affect the properties of the detergent. Thus, there may be used various coloring agents and perfumes; sequestering agents such as ethylene diamine tetraacetates; pearlescing agents and opacifiers; pH modifiers; etc. The proportion of such adjuvant materials, in total will normally not exceed 15% of weight of the detergent composition, and the percentages of most of such individual components will be about 0.1 to 5% by weight and preferably less than about 2% by weight. Sodium bisulfite can be used as a color stabilizer at a concentration of about 0.01 to 0.2 wt. %. Typical perservatives are dibromodicyanobutane, citric acid, benzylic alcohol and poly (hexamethylene-biguamide) hydrochloride and mixtures thereof. Other ingredients can be added to the compositions at concentrations of about 0.1 to 4.0 wt. percent are perfumes, preservatives, color stabilizers, sodium bisulfite, ETDA, and proteins such as lexine protein.

The instant composition can optionally contain 0 to 5 wt. %, more preferably 0.1 wt. % to 3 wt. % of a proton donating agent, wherein the proton donating agent is selected from the group consisting of inorganic acids such as hydrochloric acid or phosphoric acid and hydroxy containing organic acids such as lactic acid, citric acid, salicylic acid and ortho hydroxy benzoic acid and mixtures thereof.

The instant compositions can contain about 0 to about 14 wt. percent, more preferably 0.5 to 10 wt. percent of an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or Ti galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $R20O(C_nH2_nO)r(Z)x$ wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}\ O\ (C_6H_{10}O_5)_xH$$

wherein n=10 (2%); n=122 (65%); n=14 (21–28%); n=16 (4–8%) and n=18 (0.5%) and x (degree of polymerization)= 1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The present light duty liquid detergents such as dishwashing liquids are readily made by simple mixing methods from readily available components which, on storage, do not adversely affect the entire composition. The apparent viscosity of the composition desirably will be at least 1000 to about 6000 mpa.s at room temperature, but may be up to about 7000 mPa.s as measured with a Paar Physica UDS 200 rheometer at a shear rate of 10.8 $s^{-1}$, more preferably 2000 to 5000 mPa.s and most preferably 3000 to 4000 mpa.s. Its viscosity may approximate those of commercially acceptable compositions now on the market. The composition viscosity and the composition itself remain stable on storage for lengthy periods of time, without color changes or settling out of any insoluble materials. The pH of the instant composition is about 3.5 to 7.5 and preferably about 5.5 to 7 and the composition is optically clear. The instant compositions have a minimum foam height of 110 mls after 55 rotations at 40° C. as measured by the foam volume test using 0.75 grams of the composition per liter of water and 1 gram of corn oil per liter of water having a hardness of 300 ppm.

EXAMPLE1

| | A | B | C | D | E |
|---|---|---|---|---|---|
| Nonionic Neodol 91-8 | 4.5 | 4.5 | 4.5 | 4.5 | 4.5 |
| Ethoxylated alkyl ether sulfate (AEOS.2EO) | 4.0 | 4.0 | 4.0 | 4.0 | 4.0 |
| PEG300 | 1.0 | 1.0 | 1.0 | 1.0 | 1.0 |
| $MgSO_4.7H_2O$ | 1.0 | 1.0 | 1.0 | 0.0 | 1.0 |
| Sodium $C_{14}$–$C_{17}$ paraffin sulfonate | 25.0 | 25.0 | 25.0 | 25.0 | 25.0 |
| Oil containing gelatin beads #HC774 | 0.2 | 0.2 | 0.2 | 0.2 | 0.2 |
| Carbopol Aqua 30 | 2.5 | 2.0 | 3.0 | 2.5 | 2.5 |
| Perfume | 0.21 (Perfume 1) | 0.21 (Perfume 1) | 0.21 (Perfume 1) | 0.21 (Perfume 1) | 0.40 (Perfume 2) |
| Water | Bal. | Bal. | Bal. | Bal. | Bal. |
| pH | 6.0 | 6.0 | 6.0 | 6.0 | 6.5 |
| Clarity | OK | OK | OK | NOT OK | OK |
| G' (Pa) at frequency = 1 Hz, strain = 1%, T = 25° C. | 30 | 10 | 63 | 34 | 34 |
| G" (Pa) at frequency = 1 Hz, strain = 1%, T = 25° C. | 24 | 14 | 43 | 27 | 27 |
| Apparent viscosity (mPa · s) at shear rate = 10.8 $s^{-1}$ | 3600 | 2210 | 6980 | 4040 | 3540 |
| Apparent viscosity (mPa · s) at shear rate = 100 $s^{-1}$ | 1840 | 1270 | 3090 | 1990 | 1810 |
| Gardner index * | 100 | — | — | — | — |
| Shake foam index * | 100 | — | — | — | — |
| Miniplates index * | 110 | — | — | — | — |

* compared to same base without Carbopol Aqua 30 (ref. = 100)

The ingredients are added in the composition under moderate to strong mixing conditions following the preferred next sequence: add thickening agent in water; add anionic surfactants e.g. paraffin sulfonate and alcohol ethoxy sulfate; adjust pH to 6.5–7.0 (with appropriate alkaline agent, preferably KOH); add other surfactants e.g. ethoxylated fatty alcohol; and add other ingredients e.g. PEG 300, preservative, $MgSO_4 7 H_2O$ and perfume.

What is claimed is:

1. A light duty, liquid cleaning composition comprising approximately, by weight:

(a) 1% to 10% of a water soluble nonionic surfactant;

(b) 20% to 40% of a water-soluble anionic sulfonate surfactant;

(c) 0.1% to 6.0% of a polyethylene glycol;

(d) 0.25% to 6% of an ethoxylated alkyl ether sulfate surfactant;

(e) 2% to 5% of a polyacrylate polymeric thickener;

(f) 0.05 to 4% of oil containing gelatin bead particles which are stably suspended in said light duty liquid cleaning composition;

(g) the balance being water.

2. A liquid cleaning composition according to claim 1 wherein said nonionic surfactant is said condensate of a primary $C_8$–$C_{18}$ alkanol with 5–30 moles of ethylene oxide.

3. A liquid cleaning composition according to claim 2 wherein said anionic sulfonate is selected from the group consisting of $C_{10}$–$C_{15}$ alkylbenzene sulfonates, $C_{13}$–$C_{17}$ paraffin sulfonates and $C_{12}$–$C_{18}$ alpha olefin sulfonates.

4. A liquid cleaning composition according to claim 1 further including 0.1 to 4.0 wt. % of a perservative.

5. A liquid cleaning composition according to claim 1 further including a magnesium inorganic salt.

6. A liquid cleaning composition according to claim 1 further including a proton donating agent.

* * * * *